US007829814B2

(12) United States Patent
Marchand et al.

(10) Patent No.: US 7,829,814 B2
(45) Date of Patent: Nov. 9, 2010

(54) VACUUM CIRCUIT INTERRUPTER GROUNDING ASSEMBLY

(75) Inventors: Francois J. Marchand, Mendham, NJ (US); Haiyan Ma, YangZhou (CN); Brad R. Leccia, Bethel Park, PA (US); Ying Che, JiangSu (CN); Chun Jiang Zhang, SuZhou (CN)

(73) Assignee: Eaton Corporation, Cleveland, OH (US)

( * ) Notice: Subject to any disclaimer, the term of this patent is extended or adjusted under 35 U.S.C. 154(b) by 514 days.

(21) Appl. No.: 11/861,775

(22) Filed: Sep. 26, 2007

(65) Prior Publication Data

US 2009/0078681 A1 Mar. 26, 2009

(51) Int. Cl.
*H01H 33/666* (2006.01)

(52) U.S. Cl. ..... 218/140; 218/154

(58) Field of Classification Search ..... 218/7, 218/10, 13, 14, 78, 84, 118, 140, 152–154
See application file for complete search history.

(56) References Cited

U.S. PATENT DOCUMENTS 6,255,615 B1 7/2001 Kimblin
6,720,515 B2 4/2004 Renz et al.
7,250,583 B2 * 7/2007 Cameroni et al. ..... 218/7
2005/0139579 A1 * 6/2005 Sakamoto et al. ..... 218/118

OTHER PUBLICATIONS

Kajiwara, Satoru, et al., "Development of 24-kV Switchgear with Multi-functional Vacuum Interrupters for Distribution," Hitachi Review, vol. 49, No. 2, 2000, pp. 93-100.
Jüttner, Burkhard, et al., "Instabilities of prebreakdown currents in vacuum I: late breakdowns," J. Phys. D: Appl. Phys. 32, 1999, pp. 2537-2543.
ABB Power Technologies S.p.A., "SHS2 Gas-insulated switching and isolating apparatus", 2004, pp. i, 1-24, ii.

* cited by examiner

*Primary Examiner*—Renee Luebke
*Assistant Examiner*—Marina Fishman
(74) *Attorney, Agent, or Firm*—Martin J. Moran

(57) ABSTRACT

A vacuum circuit interrupter having a pole unit structure and an operating mechanism structured to move the vacuum circuit interrupter contacts between a first, closed position, wherein a movable contact is coupled to, and in electrical communication with, a fixed contact, and a second, open position wherein the movable contact is spaced from, and not in electrical communication with, the fixed contact, as well as being structured to rotate a housing assembly rotatable portion between a first position, wherein a rotatable terminal is coupled to, and in electrical communication with, a line terminal, and a second position, wherein the rotatable terminal is coupled to, and in electrical communication with, a grounded terminal.

16 Claims, 4 Drawing Sheets

VACUUM CIRCUIT INTERRUPTER GROUNDING ASSEMBLY

BACKGROUND OF THE INVENTION

1. Field of the Invention

This invention relates to circuit interrupters and, more specifically, to vacuum circuit interrupters, such as, for example, vacuum circuit interrupters having a grounding device.

2. Background Information

Circuit breakers and other such devices provide protection for electrical systems from electrical fault conditions such as current overloads, short circuits, and low level voltage conditions. Typically, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum chamber within a housing. Generally, one of the contacts is fixed relative to both the housing and to an external electrical conductor which is interconnected with the circuit to be protected by the circuit interrupter. The other contact is moveable. In the case of a vacuum circuit interrupter, the moveable contact assembly usually comprises a copper stem of circular cross-section having the contact at one end enclosed within the vacuum chamber, and a driving mechanism at the other end which is external to the vacuum chamber.

Vacuum interrupters are, typically, used to interrupt medium voltage alternating current (AC) currents and, also, high voltage AC currents of several thousands of amperes or more. Typically, one vacuum interrupter is provided for each phase of a multi-phase circuit and the vacuum interrupters for the several phases are actuated simultaneously by a common operating mechanism, or separately or independently by separate operating mechanisms. It is known to provide a three-position switching and isolating apparatus, including gas-insulated switch-disconnectors and isolators, suitable for use in medium voltage switchgear. Contacts for closing, breaking, isolation and earthing, or grounding, are arranged inside a cylinder in sulfur hexafluoride (SF6) gas typically at a pressure of about 202 kPa absolute. The contacts can take three positions: closed, opened and grounded. It is further known to electrically connect such a three-position switching and isolating apparatus in series with a circuit breaker or fuse, which may also interrupt the current.

It is desirable to integrate the current interruption and the grounding functions of a vacuum interrupter into a single device or mechanism. That is, it is desirable to have an operating mechanism that performs the function of separating the contacts within the vacuum chamber as well as the function of electrically coupling the load side contact with a grounded terminal, thereby grounding the load side of the circuit. The typical procedure for performing these operations was to separate the contacts, decouple the line side contact from the line terminal, couple the line side contact with a grounded terminal, and close the contacts. The devices for decoupling the line side contact from the line terminal, coupling the line side contact with a grounded terminal, however, are typically complex.

There is, therefore, a need for a simple device structured to decouple the line side contact from the line terminal, and couple the line side contact with a grounded terminal.

There is a further need for a device structured to decouple the line side contact from the line terminal, and couple the line side contact with a grounded terminal having a reduced number of components.

SUMMARY OF THE INVENTION

These needs, and others, are met by the disclosed vacuum circuit interrupter having an axially rotatable pole unit structure. The vacuum circuit interrupter has a line terminal, a load terminal, a ground terminal, and an operating mechanism. The pole unit structure includes a housing assembly and a vacuum chamber. The vacuum chamber houses a fixed contact and a movable contact. The operating mechanism, as is well known in the art, is structured to move the contacts between a first, closed position, wherein the movable contact is coupled to, and in electrical communication with, the fixed contact, and a second, open position wherein the movable contact is spaced from, and not in electrical communication with, the fixed contact. The movable contact, however, is part of a larger movable contact assembly. The movable contact assembly further includes a base assembly, which is in electrical communication with the movable contact. The base assembly includes a fixed portion and a rotatable portion. Similarly, the pole unit housing assembly has a fixed portion and a rotatable portion. The base assembly fixed portion is disposed within, and coupled to the housing assembly fixed portion. The base assembly rotatable portion is disposed within, and coupled to the housing assembly rotatable portion. The load terminal is coupled to, and in electrical communication with, the base assembly fixed portion. The housing assembly rotatable portion includes a rotatable terminal that is structured to selectively engage either the line terminal or the grounding terminal. The rotatable terminal is in electrical communication with the fixed contact. The operating mechanism is also structured to rotate the housing assembly rotatable portion. Thus, in this configuration, the operating mechanism is structured to open and close the contacts as well as rotate the housing assembly rotatable portion between a first position, wherein the rotatable terminal is coupled to, and in electrical communication with, the line terminal, and a second position, wherein the rotatable terminal is coupled to, and in electrical communication with, the grounding terminal.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, e.g., "above," "below," "upper," "lower," etc., are used for convenience relative to the Figures and are not intended to limit the claims.

As used herein, "coupled" means a link between two or more elements, whether direct or indirect, so long as a link occurs.

As used herein, two or more components are in a "fixed relationship" when the components remain in the same general orientation and spacing from each other while moving relative to another component. The components in a fixed relationship may move slightly relative to each other, for example, due to a component flexing or due to play at a joint or other interface.

Figure 1:
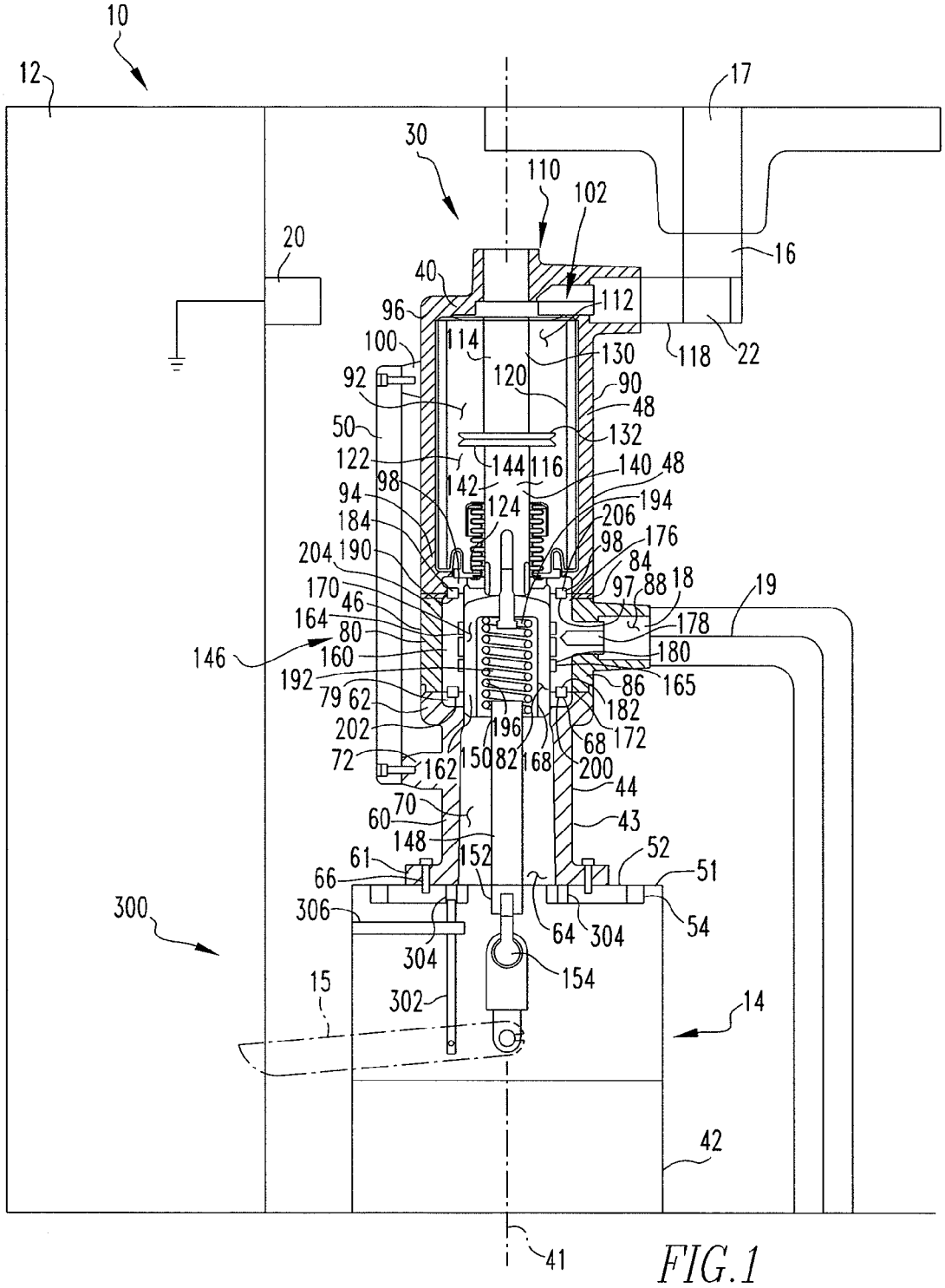
FIG. 1 is a partially schematic side view of a vacuum circuit interrupter with the contacts closed and a rotatable terminal coupled to a line terminal.
Figure 2:
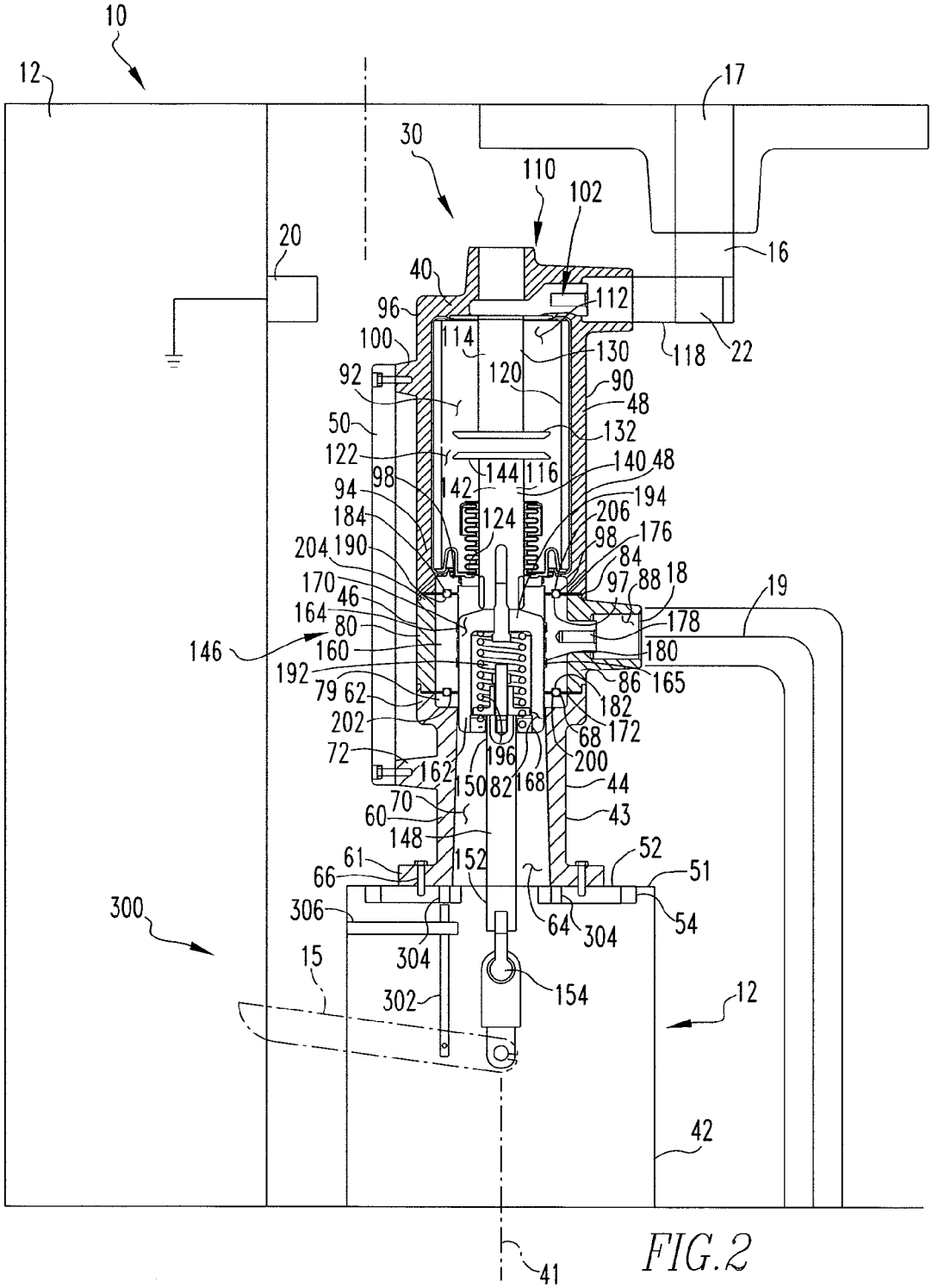
FIG. 2 is a partially schematic side view of a vacuum circuit interrupter with the contacts open and a rotatable terminal coupled to a line terminal.
Figure 3:
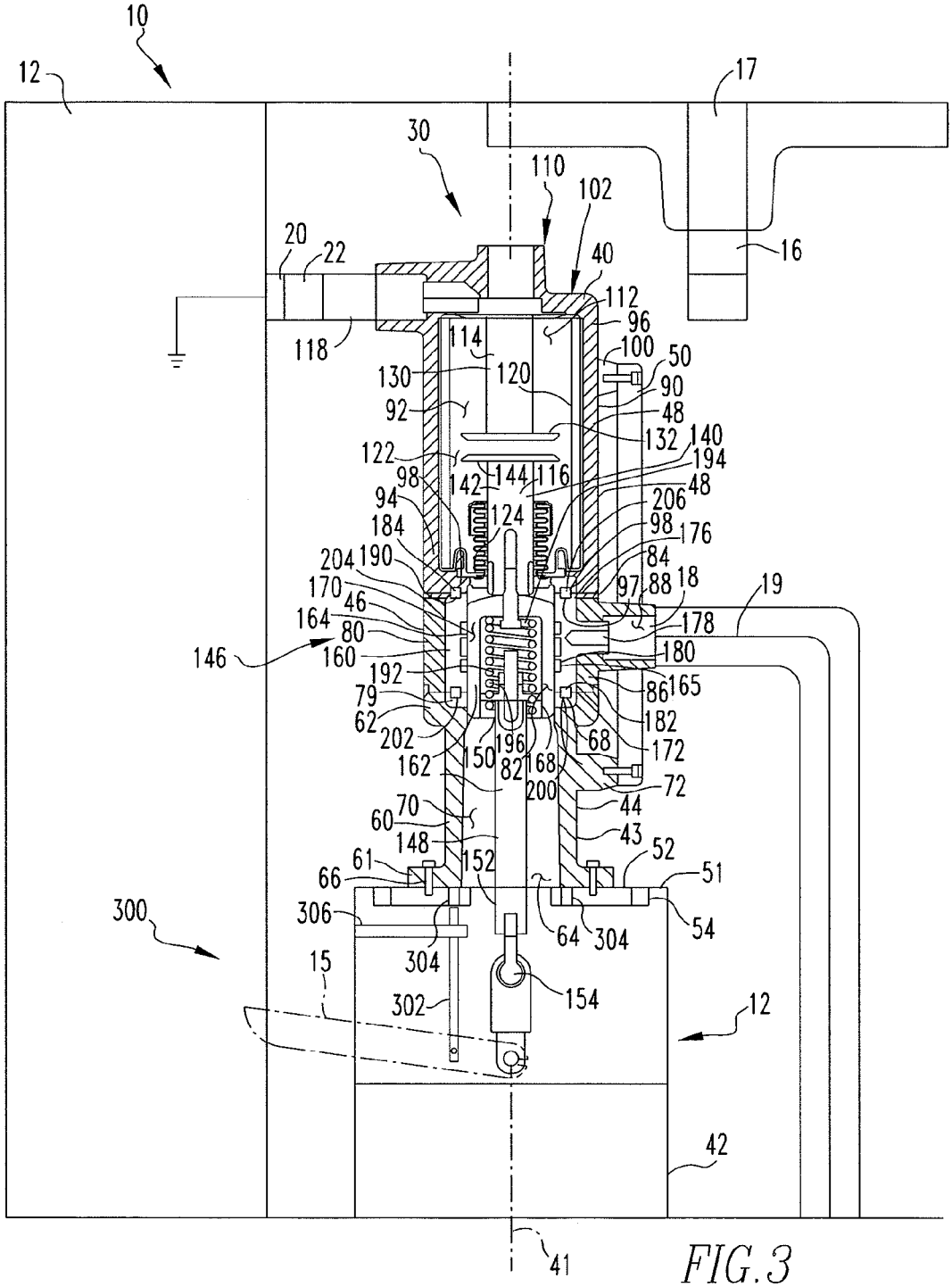
FIG. 3 is a partially schematic side view of a vacuum circuit interrupter with the contacts open and a rotatable terminal coupled to a grounding terminal.
Figure 4:
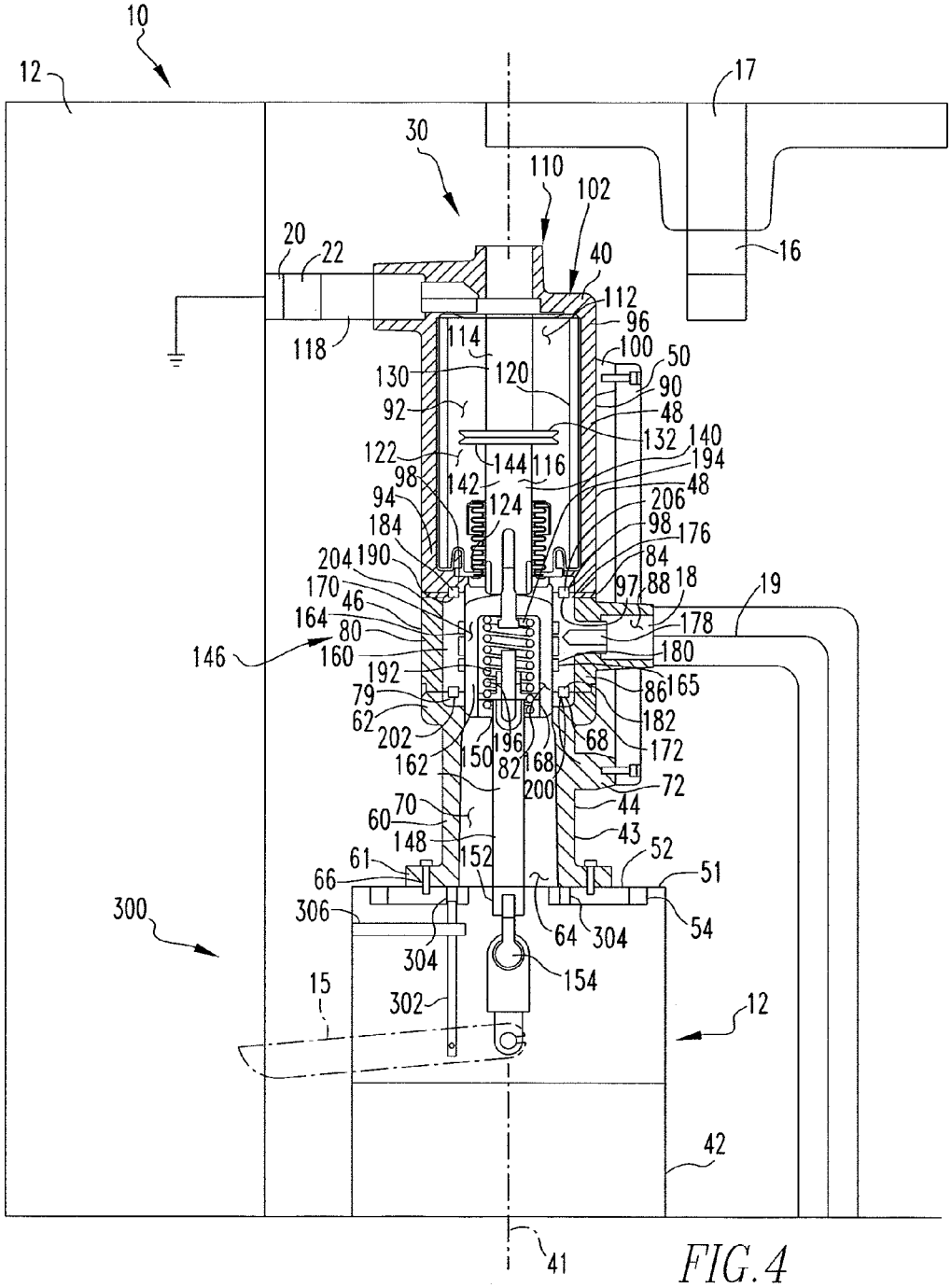
FIG. 4 is a partially schematic side view of a vacuum circuit interrupter with the contacts closed and a rotatable terminal coupled to a grounding terminal.

As shown in FIG. 1, a vacuum circuit interrupter 10 includes a housing 12 that encloses a control device (not shown), an operating mechanism 14 (shown schematically), a line terminal 16, a load terminal 18, a grounded terminal 20 and a pole unit structure 30. The line terminal 16 and the grounded terminal 20 are, preferably, disposed in the same general horizontal plane. As is known in the art, the control device, which may include components such as, but not limited to, a manual actuator, an automatic actuator, and/or a trip device, is structured to actuate the operating mechanism 14 in response to a user command or an over-current condition. The effect of actuating the operating mechanism 14 is discussed below. The line terminal 16 is coupled to, and in electrical communication with, a line conductor 17 which is further coupled to, and in electrical communication with, a power source (not shown). The load terminal 18 is coupled to, and in electrical communication with, a load conductor 19 which is further coupled to, and in electrical communication with, a load (not shown). The grounded terminal 20 is coupled to, and in electrical communication with, a ground (shown schematically). Each of the upper terminals, that is, the line terminal 16, the grounded terminal 20, and a rotatable terminal 118 (described below) have a coupling device 22 (shown schematically) such as, but not limited to a finger cluster, structured to allow the rotatable terminal 118 to be coupled to and in electrical communication with, or, decoupled from, either the line terminal 16 or the grounded terminal 20. When the rotatable terminal 118 is decoupled from either the line terminal 16 or the grounded terminal 20, the rotatable terminal 118 is no longer in electrical communication therewith.

The pole unit structure 30 includes a housing assembly 40 and a vacuum envelope assembly 110. The housing assembly 40 is, generally, made from a non-conductive material. The housing assembly 40 is generally elongated and has a longitudinal axis 41. In one embodiment (not shown) the load terminal 18 is structured to support the weight of the pole unit structure 30, however, in the embodiment shown in FIG. 1-4 the housing assembly 40 includes a fixed support 42, at least one rotatable portion 43, which in this embodiment includes a first, lower rotatable portion 44, a fixed portion 46, a second, upper rotatable portion 48 and a connection bar 50. The fixed support 42 remains generally stationary relative to the line terminal 16, the load terminal 18, and the grounded terminal 20. The fixed support 42 is further structured to generally support the weight of the vacuum envelope assembly 110, the housing assembly first, lower rotatable portion 44, the housing assembly fixed portion 46, and the housing assembly second, upper rotatable portion 48. The fixed support 42 may further be structured to partially enclose an actuation arm 15 of the operating mechanism 14. As is known in the art, the actuation arm 15 moves in a generally vertical plane and is structured to move the movable contact assembly stem 142 (described below) as discussed below. The fixed support 42, preferably, has a generally horizontal upper surface 51 and includes a turnable bearing 52. The turnable bearing 52 has a generally circular outer surface 54. The turnable bearing 52 has an axis of rotation that is generally aligned with the housing assembly longitudinal axis 41. The turnable bearing 52 is structured to rotate, typically about 180 degrees, between a first position and a second position relative to the fixed support 42. The at least one rotatable portion 43 is coupled to the turnable bearing 52 and, as such, is rotatable relative to the fixed support 42.

Preferably, the housing assembly first, lower rotatable portion 44 is a hollow, generally cylindrical body 60. The housing assembly first, lower rotatable portion 44 has a lower end 61 and an upper end 62. The housing assembly first, lower rotatable portion lower end 61 is structured to be coupled to the turnable bearing 52 in a fixed relation. For example, and as shown, the housing assembly first, lower rotatable portion lower end 61 may have at least one opening 64 through which a fastener 66 may be passed and coupled to the turnable bearing 52. The housing assembly first, lower rotatable portion upper end 62 has an axial facing, generally circumferential channel 68. The housing assembly first, lower rotatable portion upper end 62 may include an inner ring 79 made from a durable and/or low-friction material such as, but not limited to, nylon. The housing assembly first, lower rotatable portion upper end axial facing circumferential channel 68 may be disposed on the housing assembly first, lower rotatable portion upper end inner ring 79. The housing assembly first, lower rotatable portion 44 includes an axial cavity 70 extending from the housing assembly first, lower rotatable portion lower end 61 through the housing assembly first, lower rotatable portion upper end 62. That is, the housing assembly first, lower rotatable portion 44 is generally hollow with open ends. The housing assembly first, lower rotatable portion 44 also includes a connection bar mounting 72 extending radially from the housing assembly first, lower rotatable portion 44 outer surface. The housing assembly first, lower rotatable portion connection bar mounting 72 is structured to be coupled to the connection bar 50.

Preferably, the housing assembly fixed portion 46 is also a hollow, generally cylindrical body 80. The housing assembly fixed portion 46 includes a central cavity 82, an upper end 84, a lower end 86 and a load terminal passage 88. The load terminal passage 88 is an opening extending generally radially through the housing assembly fixed portion body 80. The load terminal 18 extends through the load terminal passage 88 and is coupled to, and in electrical communication with, the movable contact assembly 116, as described below. The housing assembly fixed portion 46 is also coupled to a movable contact assembly base assembly fixed portion 160 as described below.

Preferably, the housing assembly second, upper rotatable portion 48 is also a hollow, generally cylindrical body 90. The housing assembly second, upper rotatable portion 48 includes a central cavity 92, a lower end 94 and an upper end 96. The housing assembly second, upper rotatable portion lower end 94 has an axial facing, generally circumferential channel 97. The housing assembly second, upper rotatable portion lower end 94 may include an inner ring 98 made from a durable and/or low-friction material such as, but not limited to, nylon. The housing assembly second, upper rotatable portion lower end axial facing circumferential channel 97 may be disposed on the housing assembly second, upper rotatable portion inner ring 98. The housing assembly second, upper rotatable portion 48 also includes a connection bar mounting 100 extending radially from the housing assembly second, upper rotatable portion 48 outer surface. The housing assembly second, upper rotatable portion connection bar mounting 100 is structured to be coupled to a connection bar 50. The housing assembly second, upper rotatable portion upper end 96 includes a rotatable terminal passage 102. The rotatable terminal passage 102 allows the rotatable terminal 118 to extend from a location outside the housing assembly second, upper rotatable portion body 90 to a location within the housing assembly second, upper rotatable portion cavity 92.

The vacuum envelope assembly 110 includes a vacuum chamber 112, an elongated, fixed contact 114, a movable contact assembly 116, and a rotatable terminal 118. The vacuum chamber 112 includes a sidewall 120 defining an enclosed space 122. As is known in the art, the vacuum chamber sidewall 120 is sealingly coupled to the fixed contact 114 and the movable contact assembly 116. The vacuum chamber sidewall 120 may have a bellows 124, or similar structure, adjacent to the interface with the movable contact assembly 116. The fixed contact 114 preferably includes a stem 130 and a contact plate 132. The movable contact assembly 116 includes an elongated, movable contact 140, which has a stem 142 and a contact plate 144, a base assembly 146 and a drive insulator 148.

The fixed contact 114 and the movable contact 140 are each substantially enclosed within the vacuum chamber enclosed space 122. That is, a portion of the fixed contact stem 130 and a portion of the movable contact stem 142 each penetrate the vacuum chamber sidewall 120. The external portion of the fixed contact stem 130 is coupled to, and in electrical communication with, the rotatable terminal 118. The external portion of the movable contact stem 142 is coupled to, and in electrical communication with, the base assembly 146. The fixed contact 114 is generally stationary relative to the vacuum chamber sidewall 120. The movable contact 140 assembly 116 is structured to move between a first, closed position, wherein the movable contact assembly 116 is coupled to, and in electrical communication with, the fixed contact 114, and a second, open position wherein the movable contact assembly 116 is spaced from, and not in electrical communication with, the fixed contact 114. It is noted that the actuation arm 15 moves between a corresponding first, upper position and a second, lower position. The drive insulator 148 is a non-conductive body which has a first end 150 and a second end 152. The drive insulator second end 152 includes a ball and the actuation arm 15 includes a spherical socket. The ball and socket form a ball joint 154 that couples the drive insulator second end 152 to the actuation arm 15.

The base assembly 146 includes a fixed portion 160, a rotatable portion 162, and may include a conductive structure 164. The base assembly fixed portion 160 has a body 166 with an inner surface 168 defining a generally cylindrical cavity 170, a lower surface 172, an upper surface 176 and load terminal coupling 178. The load terminal coupling 178 is coupled to, and in electrical communication with, the load terminal 18. The base assembly fixed portion inner surface 168 has at least one circumferential groove 180. The base assembly fixed portion lower surface 172 has a first, lower axial facing, generally circumferential channel 182. The base assembly fixed portion first, lower axial facing, generally circumferential channel 182 is sized to correspond to the housing assembly first, lower rotatable portion upper end axial facing, generally circumferential channel 68. The base assembly fixed portion upper surface 176 has a second, upper axial facing, generally circumferential channel 184. The base assembly fixed portion second, upper axial facing, generally circumferential channel 184 is sized to correspond to the housing assembly second upper rotatable portion lower end axial facing, generally circumferential channel 97.

The base assembly rotatable portion 162 has a generally cylindrical body 190 having a diameter sized to rotatably engage the base assembly fixed portion inner surface 168. The base assembly rotatable portion cylindrical body 190 may define a cavity 192 having a biasing device 194, such as a spring 196, disposed therein. As noted above, the external portion of the movable contact stem 142 is coupled to, and in electrical communication with, the base assembly 146. More specifically, the base assembly rotatable portion 162 is coupled to the movable contact stem 142 in a fixed relationship.

The operating mechanism 14 is structured to move the movable contact assembly 116 linearly between the movable contact assembly first position and second position. The operating mechanism 14 is structured to rotate the movable contact assembly 116 about the movable contact assembly 116 longitudinal axis. Preferably, the operating mechanism 14 is structured to is structured to rotate the turnable bearing 52, which via the connections described herein, cause the movable contact assembly 116 to rotate about the movable contact assembly 116 longitudinal axis. As described below, the movable contact assembly 116 is maintained in a fixed relationship to the housing assembly first, lower rotatable portion 44 and the housing assembly second, upper rotatable portion 48.

The pole unit structure 30 is assembled as follows. The operating mechanism 14 is coupled to the fixed support turnable bearing 52 and is structured to rotate the fixed support turnable bearing 52 relative to the fixed support 42. The housing assembly first, lower rotatable portion lower end 61 is coupled to the fixed support turnable bearing 52.

The base assembly fixed portion 160 is disposed within the housing assembly fixed portion 46 in a fixed relationship. As noted above, the load terminal 18 extends through the load terminal passage 88 and is coupled to, and in electrical communication with, the base assembly fixed portion 160. The base assembly rotatable portion 162 is rotatably disposed within the base assembly fixed portion cylindrical cavity 170. The base assembly rotatable portion 162 and the base assembly fixed portion 160 are in electrical communication with each other. In one embodiment, the conductive structure 164, which may be at least one conductive spring 165 is disposed within the base assembly fixed portion inner surface circumferential groove 180. The at least one conductive spring 165 is in electrical communication with both the base assembly fixed portion 160 and the base assembly rotatable portion 162.

The vacuum chamber 112 is disposed within the housing assembly second, upper rotatable portion 48 in a fixed relationship. More specifically, the vacuum chamber 112 is disposed within the housing assembly second, upper rotatable portion central cavity 92 As noted above, the external portion of the fixed contact stem 130 is coupled to, and in electrical communication with, the rotatable terminal 118. Preferably, the fixed contact 114 extends generally vertical and the rotatable terminal 118 extends generally perpendicular to the axis of the fixed contact 114. As further noted above, the base assembly rotatable portion 162 is coupled to, and in electrical communication with the movable contact stem 142. Further, the base assembly rotatable portion 162 is coupled to the movable contact stem 142 in a fixed relationship.

The base assembly fixed portion 160 is further rotatably coupled to the housing assembly first, lower rotatable portion 44. Preferably, the base assembly fixed portion 160 is disposed on top of the housing assembly first, lower rotatable portion 44 so that the housing assembly first, lower rotatable portion axial facing circumferential channel 68 and the base assembly fixed portion upper end channel 68 first, lower axial facing, generally circumferential channel 182 form a first bearing passage 200. At least one bearing 202 such as, but not limited to, a ball bearing 204, is disposed within the first bearing passage 200. In this configuration, the housing assembly first, lower rotatable portion 44 is structured to rotate relative to the fixed support 42 and the base assembly fixed portion 160.

The housing assembly second, upper rotatable portion 48 is rotatably disposed on top of the housing assembly fixed portion 46. Preferably, the housing assembly second, upper rotatable portion 48 is disposed on the housing assembly fixed portion 46 so that the housing assembly second, upper rotatable portion lower end axial facing circumferential channel 97 and the base assembly fixed portion second, upper axial facing, generally circumferential channel 184 form a second bearing passage 206. As with the first bearing passage 200, at least one bearing 202 such as, but not limited to, a ball bearing 204, is disposed within the second bearing passage 206. In this configuration, the housing assembly second, upper rotatable portion 48 is structured to rotate relative to the base assembly fixed portion 160. Further, the housing assembly at least one rotatable portion 43, that is, the housing assembly second, upper rotatable portion 48, is structured to rotate about the housing assembly longitudinal axis 41 between a first position, wherein the rotatable terminal 118 is coupled to the line terminal 16, and a second position, wherein the rotatable terminal 118 is coupled to the grounded terminal 20.

As noted above, the drive insulator second end ball joint 154 couples the drive insulator second end 152 to the actuation arm 15. The drive insulator 148 extends through the housing assembly first, lower rotatable axial cavity 70 and the drive insulator first end 150 is coupled to the base assembly rotatable portion 162 in a fixed relationship. Preferably, the drive insulator 148 longitudinal axis, the movable contact 140 longitudinal axis, the base assembly 146 longitudinal axis, and the turnable bearing 52 axis of rotation are each generally aligned with the housing assembly 40 longitudinal axis. The connection bar 50 extends between, and is coupled to, the housing assembly first, lower rotatable portion connection bar mounting 72 and the housing assembly second, upper rotatable portion connection bar mounting 100. The connection bar 50 maintains the housing assembly first, lower rotatable portion 44 and the housing assembly second, upper rotatable portion 48 in a generally fixed relationship. As noted above, the load terminal 18 may be structured to support the weight of the pole unit structure 30. In such an embodiment, the fixed support 42, the housing assembly first, lower rotatable portion 44 and the connection bar 50 are not required.

In this configuration, the operating mechanism 14 may be used to move the movable contact assembly 116 linearly between the movable contact assembly first position and second position as well as rotate the housing assembly second, upper rotatable portion 48 between a first position, wherein the rotatable terminal 118 is coupled to the line terminal 16, and a second position, wherein the rotatable terminal 118 is coupled to the grounded terminal 20. It is noted that the rotatable portions of the housing assembly, and specifically the at least one rotatable portion 43 and the second, upper rotatable portion 48, have a corresponding rotation with the rotatable terminal 118.

In operation, a user may ground the load side of the circuit as follows. With the movable contact assembly 116 in the first position and the housing assembly second, upper rotatable portion 48 in a first position, the user actuates the operating mechanism 14 to move the movable contact assembly 116 into the second position, thereby interrupting the circuit and de-energizing the load terminal 18 and load conductor 19. The user then actuates the operating mechanism 14 to move the housing assembly second, upper rotatable portion 48 into the second position wherein the rotatable terminal 118 is coupled to the grounded terminal 20. The user then actuates the operating mechanism 14 again to move the movable contact assembly 116 back into the first position. With the rotatable terminal 118 coupled to the grounded terminal 20 and the movable contact assembly 116 in the first position, the load side of the circuit is grounded.

The pole unit structure 30 preferably includes an interlock assembly 300. The interlock assembly 300 is structured to prevent the housing assembly second, upper rotatable portion 48 from moving between the first position and the second position when the movable contact assembly 116 is in the first, closed position. In one embodiment, the interlock assembly 300 includes a lock rod 302 and a pair of openings 304 in turnable bearing 52. The lock rod 302 is coupled to the actuation arm 15 and extends toward the turnable bearing 52. The interlock assembly 300 may include a guide 306 to position the lock rod 302. The interlock assembly openings 304 are, preferably, positioned about 180 degrees apart and are positioned on the turnable bearing 52 so that one interlock assembly opening 304 aligns with the lock rod 302 when the housing assembly second, upper rotatable portion 48 is in the first position, and so that the other interlock assembly opening 304 aligns with the lock rod 302 when the housing assembly second, upper rotatable portion 48 is in the second position.

In this configuration, the lock rod 302 may move between a first position, wherein the lock rod 302 is disposed in, or through, an interlock assembly opening 304 when the actuation arm 15 is in the first, upper position. When the actuation arm 15 is dispose in an interlock assembly opening 304, the turnable bearing 52 is prevented from rotating. As the actuation arm 15 is in the first, upper position when the movable contact assembly 116 is the first, closed position, the turnable bearing 52, and therefore the housing assembly rotatable portion 43, may not rotate when the contacts plates 132, 144 are in electrical communication.

While specific embodiments of the invention have been described in detail, it will be appreciated by those skilled in the art that various modifications and alternatives to those details could be developed in light of the overall teachings of the disclosure. For example, in one embodiment the housing assembly first, lower rotatable portion 44 is a generally cylindrical body. However, the housing assembly first, lower rotatable portion 44 may have any shape so long as the housing assembly first, lower rotatable portion axial facing upper end channel 68 is generally circular. This is also true for any portion of the housing assembly 40. Accordingly, the particular arrangements disclosed are meant to be illustrative only and not limiting as to the scope of invention which is to be given the full breadth of the claims appended and any and all equivalents thereof.

What is claimed is:

1. A pole unit structure for a vacuum circuit interrupter, said vacuum circuit interrupter having a line terminal, a load terminal, a grounded terminal, and an operating mechanism, said operating mechanism structured to move a movable contact linearly and to rotate the movable contact about a longitudinal axis, said pole unit structure comprising:

an elongated housing assembly having a longitudinal axis, at least one rotatable portion and a fixed portion;

said housing assembly at least one rotatable portion having a rotatable terminal;

said housing assembly at least one rotatable portion structured to rotate about said housing assembly longitudinal axis between a first position, wherein said rotatable terminal is coupled to said line terminal, and a second position, wherein said rotatable terminal is coupled to said grounded terminal;

a vacuum envelope assembly having a vacuum chamber, said vacuum chamber disposed within, and in a fixed relationship to, said housing assembly at least one rotatable portion, said vacuum envelope assembly having a fixed contact and a movable contact assembly, said fixed contact disposed within said vacuum chamber;

said movable contact assembly structured to move between a first, closed position, wherein said movable contact assembly is coupled to, and in electrical communication with, said fixed contact, and a second, open position wherein said movable contact assembly is spaced from, and not in electrical communication with, said fixed contact;

said fixed contact being in electrical communication with said rotatable terminal;

said load terminal coupled to said housing assembly fixed portion and coupled to, and in electrical communication with, said movable contact assembly;

said movable contact assembly coupled to said operating mechanism; and wherein said operating mechanism is structured to linearly move said movable contact assembly between said first, closed position and said second, open position and to rotate said movable contact assembly, thereby rotating said housing assembly rotatable portion between said first position and said second position; and wherein said housing assembly includes an interlock assembly, said interlock assembly structured to prevent said housing assembly at least one rotatable portion from moving between said first position and said second position when said movable contact is in said first, closed position.

2. A pole unit structure for a vacuum circuit interrupter, said vacuum circuit interrupter having a line terminal, a load terminal, a grounded terminal, and an operating mechanism, said operating mechanism structured to move a movable contact linearly and to rotate the movable contact about a longitudinal axis, said pole unit structure comprising:

an elongated housing assembly having a longitudinal axis, at least one rotatable portion and a fixed portion;

said housing assembly at least one rotatable portion having a rotatable terminal;

said housing assembly at least one rotatable portion structured to rotate about said housing assembly longitudinal axis between a first position, wherein said rotatable terminal is coupled to said line terminal, and a second position, wherein said rotatable terminal is coupled to said grounded terminal;

a vacuum envelope assembly having a vacuum chamber, said vacuum chamber disposed within, and in a fixed relationship to, said housing assembly at least one rotatable portion, said vacuum envelope assembly having a fixed contact and a movable contact assembly, said fixed contact disposed within said vacuum chamber;

said movable contact assembly structured to move between a first, closed position, wherein said movable contact assembly is coupled to, and in electrical communication with, said fixed contact, and a second, open position wherein said movable contact assembly is spaced from, and not in electrical communication with, said fixed contact;

said fixed contact being in electrical communication with said rotatable terminal;

said load terminal coupled to said housing assembly fixed portion and coupled to, and in electrical communication with, said movable contact assembly;

said movable contact assembly coupled to said operating mechanism;

wherein said operating mechanism is structured to linearly move said movable contact assembly between said first, closed position and said second, open position and to rotate said movable contact assembly, thereby rotating said housing assembly rotatable portion between said first position and said second position;

said movable contact assembly includes an elongated movable contact and a base assembly, said movable contact and said base assembly being coupled together and in electrical communication;

said movable contact being disposed within said vacuum chamber;

said base assembly having a fixed portion and a rotatable portion;

said load terminal coupled to, and in electrical communication with, said base assembly fixed portion;

said base assembly fixed portion disposed within said housing assembly fixed portion;

said base assembly rotatable portion rotatably disposed within said base assembly fixed portion;

said base assembly fixed portion having a body with inner surface defining a generally cylindrical cavity; and said base assembly rotatable portion having a generally cylindrical body sized to rotatably engage said base assembly fixed portion inner surface.

3. The pole unit structure of claim 2 wherein:

said base assembly includes a conductive structure;

said conductive structure disposed between said base assembly rotatable portion and said base assembly fixed portion inner surface, said conductive structure being in electrical communication with both said base assembly rotatable portion and said base assembly fixed portion inner surface.

4. The pole unit structure of claim 3 wherein:

said base assembly fixed portion inner surface includes at least one circumferential groove; and said conductive structure being at least one conductive spring, said conductive spring disposed within said base assembly fixed portion inner surface circumferential groove and structured to engage, and be in electrical communication with, said base assembly rotatable portion.

5. The pole unit structure of claim 2 wherein:

said movable contact assembly includes an elongated drive insulator;

said drive insulator having a first end and a second end;

said drive insulator first end coupled to said rotatable portion in a fixed relationship;

said drive insulator second end having a ball joint; and said drive insulator second end coupled to said operating mechanism.

6. The pole unit structure of claim 5 wherein:

said drive insulator has a longitudinal axis;

said movable contact has a longitudinal axis;

said base assembly has a longitudinal axis; and wherein said drive insulator longitudinal axis, said movable contact longitudinal axis, and said base assembly longitudinal axis, are each generally aligned with said housing assembly longitudinal axis.

7. The pole unit structure of claim 5 wherein:

said housing assembly includes a fixed support and a connection bar;

said housing assembly at least at least one rotatable portion includes a first, lower rotatable portion and a second upper rotatable portion, said housing assembly fixed portion being disposed between said first, lower rotatable portion and a second upper rotatable portion;

said housing assembly first, lower rotatable portion rotatably coupled to said housing assembly fixed support; and said connection bar coupled to said housing assembly first, lower rotatable portion and to housing assembly second upper rotatable portion, said connection bar structured to maintain said housing assembly first, lower rotatable portion and housing assembly second upper rotatable portion in a fixed rotational relationship.

8. The pole unit structure of claim 7 wherein:

said fixed support includes a turnable bearing having an axis of rotation, said turnable bearing structured to rotate relative to said fixed support;

said turnable bearing axis of rotation being generally aligned with said housing assembly longitudinal axis;

said housing assembly first, lower rotatable portion having a lower end and an upper end;

said housing assembly first, lower rotatable portion lower end coupled to said turnable bearing;

said housing assembly first, lower rotatable portion upper end having an axial facing circumferential channel;

said base assembly having fixed portion having a lower surface and an upper surface;

said base assembly fixed portion lower surface having a first, lower axial facing, generally circumferential channel;

said base assembly fixed portion upper surface having a second, upper axial facing, generally circumferential channel;

said base assembly fixed portion first, lower axial facing, generally circumferential channel sized to correspond to said housing assembly first, lower rotatable portion upper end axial facing, generally circumferential channel;

said base assembly fixed portion first, lower axial facing, generally circumferential channel and said housing assembly first, lower rotatable portion upper end axial facing, generally circumferential channel forming a first bearing passage;

at least one bearing disposed in said first bearing passage;

said housing assembly second upper rotatable portion having a lower end with an axial facing, generally circumferential channel;

said base assembly fixed portion second, upper axial facing, generally circumferential channel sized to correspond to said housing assembly second upper rotatable portion lower end axial facing, generally circumferential channel;

said base assembly fixed portion second, upper axial facing, generally circumferential channel and said housing assembly second upper rotatable portion lower end axial facing, generally circumferential channel forming a second bearing passage;

at least one bearing disposed in said second bearing passage; and wherein said fixed support turnable bearing, said housing assembly first, lower rotatable portion and said housing assembly second upper rotatable portion are structured to rotate about said housing assembly longitudinal axis while said housing assembly fixed portion remains stationary.

9. A vacuum circuit interrupter comprising:

a line terminal, a load terminal, a grounded terminal, an operating mechanism and a pole unit structure;

said pole unit structure having an elongated housing assembly and a vacuum envelope assembly;

said elongated housing assembly having a longitudinal axis, at least one rotatable portion and a fixed portion;

said housing assembly at least one rotatable portion having a rotatable terminal;

said housing assembly at least one rotatable portion structured to rotate about said housing assembly longitudinal axis between a first position, wherein said rotatable terminal is coupled to said line terminal, and a second position, wherein said rotatable terminal is coupled to said grounded terminal;

said vacuum envelope assembly having a vacuum chamber, said vacuum chamber disposed within, and in a fixed relationship to, said housing assembly at least one rotatable portion, said vacuum envelope assembly having a fixed contact and a movable contact assembly, said fixed contact disposed within said vacuum chamber;

said movable contact assembly structured to move between a first, closed position, wherein said movable contact assembly is coupled to, and in electrical communication with, said fixed contact, and a second, open position wherein said movable contact assembly is spaced from, and not in electrical communication with, said fixed contact;

said fixed contact being in electrical communication with said rotatable terminal;

said load terminal coupled to said housing assembly fixed portion and coupled to, and in electrical communication with, said movable contact assembly;

said movable contact assembly coupled to said operating mechanism; and said operating mechanism is structured to linearly move said movable contact assembly between said first, closed position and said second, open position and to rotate said movable contact assembly, thereby rotating said housing assembly rotatable portion between said first position and said second position; and wherein said housing assembly includes an interlock assembly, said interlock assembly structured to prevent said housing assembly at least one rotatable portion from moving between said first position and said second position when said movable contact is in said first, closed position.

10. A vacuum circuit interrupter comprising:

a line terminal, a load terminal, a grounded terminal, an operating mechanism and a pole unit structure;

said pole unit structure having an elongated housing assembly and a vacuum envelope assembly;

said elongated housing assembly having a longitudinal axis, at least one rotatable portion and a fixed portion;

said housing assembly at least one rotatable portion having a rotatable terminal;

said housing assembly at least one rotatable portion structured to rotate about said housing assembly longitudinal axis between a first position, wherein said rotatable terminal is coupled to said line terminal, and a second position, wherein said rotatable terminal is coupled to said grounded terminal;

said vacuum envelope assembly having a vacuum chamber, said vacuum chamber disposed within, and in a fixed relationship to, said housing assembly at least one rotatable portion, said vacuum envelope assembly having a fixed contact and a movable contact assembly, said fixed contact disposed within said vacuum chamber;

said movable contact assembly structured to move between a first, closed position, wherein said movable contact assembly is coupled to, and in electrical communication with, said fixed contact, and a second, open position wherein said movable contact assembly is spaced from, and not in electrical communication with, said fixed contact;

said fixed contact being in electrical communication with said rotatable terminal;

said load terminal coupled to said housing assembly fixed portion and coupled to, and in electrical communication with, said movable contact assembly;

said movable contact assembly coupled to said operating mechanism;

said operating mechanism is structured to linearly move said movable contact assembly between said first, closed position and said second, open position and to rotate said movable contact assembly, thereby rotating said housing assembly rotatable portion between said first position and said second position;

said movable contact assembly includes an elongated movable contact and a base assembly, said movable contact and said base assembly being coupled together and in electrical communication;

said movable contact being disposed within said vacuum chamber;

said base assembly having fixed portion and a rotatable portion;

said load terminal coupled to, and in electrical communication with, said base assembly fixed portion;

said base assembly fixed portion disposed within said housing assembly fixed portion;

said base assembly rotatable portion rotatably disposed within said base assembly fixed portion;

said base assembly fixed portion having a body with inner surface defining a generally cylindrical cavity; and said base assembly rotatable portion having a generally cylindrical body sized to rotatably engage said base assembly fixed portion inner surface.

11. The vacuum circuit interrupter of claim 10 wherein:

said base assembly includes a conductive structure;

said conductive structure disposed between said base assembly rotatable portion and said base assembly fixed portion inner surface, said conductive structure being in electrical communication with both said base assembly rotatable portion and said base assembly fixed portion inner surface.

12. The vacuum circuit interrupter of claim 11 wherein:

said base assembly fixed portion inner surface includes at least one circumferential groove; and said conductive structure being at least one conductive spring, said conductive spring disposed within said base assembly fixed portion inner surface circumferential groove and structured to engage, and be in electrical communication with, said base assembly rotatable portion.

13. The vacuum circuit interrupter of claim 10 wherein:

said movable contact assembly includes an elongated drive insulator;

said drive insulator having a first end and a second end;

said drive insulator first end coupled to said rotatable portion in a fixed relationship;

said drive insulator second end having a ball joint; and said drive insulator second end coupled to said operating mechanism.

14. The vacuum circuit interrupter of claim 13 wherein:

said drive insulator has a longitudinal axis;

said movable contact has a longitudinal axis;

said base assembly has a longitudinal axis; and wherein said drive insulator longitudinal axis, said movable contact longitudinal axis, and said base assembly longitudinal axis, are each generally aligned with said housing assembly longitudinal axis.

15. The vacuum circuit interrupter of claim 13 wherein:

said housing assembly includes a fixed support and a connection bar;

said housing assembly at least one rotatable portion includes a first, lower rotatable portion and a second upper rotatable portion, said housing assembly fixed portion being disposed between said first, lower rotatable portion and a second upper rotatable portion;

said housing assembly first, lower rotatable portion rotatably coupled to said housing assembly fixed support; and said connection bar coupled to said housing assembly first, lower rotatable portion and to housing assembly second upper rotatable portion, said connection bar structured to maintain said housing assembly first, lower rotatable portion and housing assembly second upper rotatable portion in a fixed rotational relationship.

16. The vacuum circuit interrupter of claim 15 wherein:

said fixed support includes a turnable bearing having an axis of rotation, said turnable bearing structured to rotate relative to said fixed support;

said turnable bearing axis of rotation being generally aligned with said housing assembly longitudinal axis;

said housing assembly first, lower rotatable portion having a lower end and an upper end;

said housing assembly first, lower rotatable portion lower end coupled to said turnable bearing;

said housing assembly first, lower rotatable portion upper end having an axial facing circumferential channel;

said base assembly having a fixed portion having a lower surface and an upper surface;

said base assembly fixed portion lower surface having a first, lower axial facing, generally circumferential channel;

said base assembly fixed portion upper surface having a second, upper axial facing, generally circumferential channel;

said base assembly fixed portion first, lower axial facing, generally circumferential channel sized to correspond to said housing assembly first, lower rotatable portion upper end axial facing, generally circumferential channel;

said base assembly fixed portion first, lower axial facing, generally circumferential channel and said housing assembly first, lower rotatable portion upper end axial facing, generally circumferential channel forming a first bearing passage;

at least one bearing disposed in said first bearing passage;

said housing assembly second upper rotatable portion having a lower end with an axial facing, generally circumferential channel;

said base assembly fixed portion second, upper axial facing, generally circumferential channel sized to correspond to said housing assembly second upper rotatable portion lower end axial facing, generally circumferential channel;

said base assembly fixed portion second, upper axial facing, generally circumferential channel and said housing assembly second upper rotatable portion lower end axial facing, generally circumferential channel forming a second bearing passage;

at least one bearing disposed in said second bearing passage; and wherein said fixed support turnable bearing, said housing assembly first, lower rotatable portion and said housing assembly second upper rotatable portion are structured to rotate about said housing assembly longitudinal axis while said housing assembly fixed portion remains stationary.

* * * * *